US007172195B2

(12) United States Patent
Sano et al.

(10) Patent No.: US 7,172,195 B2
(45) Date of Patent: Feb. 6, 2007

(54) IMAGE READING APPARATUS

(75) Inventors: Kazuhide Sano, Yamanashi-ken (JP); Syunichi Hirose, Minami-Alps (JP)

(73) Assignee: Nisca Corporation, Yamanashi-Ketn (JP)

( * ) Notice: Subject to any disclaimer, the term of this patent is extended or adjusted under 35 U.S.C. 154(b) by 118 days.

(21) Appl. No.: 10/932,031

(22) Filed: Sep. 2, 2004

(65) Prior Publication Data

US 2005/0189707 A1 Sep. 1, 2005

(30) Foreign Application Priority Data

Dec. 4, 2003 (JP) ..... 2003-405439

(51) Int. Cl.
*B65H 7/12* (2006.01)

(52) U.S. Cl. ..... 271/262; 271/263; 271/265.04

(58) Field of Classification Search ..... 271/3.15, 271/317, 10.02, 10.03, 110, 258.01, 262, 271/263, 258.02, 258.03, 258.04, 265.01, 271/265.04, 152, 154, 155
See application file for complete search history.

(56) References Cited

U.S. PATENT DOCUMENTS

| | | | | |
|---|---|---|---|---|
| 4,066,969 | A * | 1/1978 | Pearce et al. | 367/125 |
| 5,389,848 | A * | 2/1995 | Trzaskos | 310/322 |
| 6,053,495 | A * | 4/2000 | Hara et al. | 271/263 |
| 6,212,130 | B1 * | 4/2001 | Brazeal et al. | 367/93 |
| 6,314,054 | B1 * | 11/2001 | Priebsch | 367/93 |
| 6,511,064 | B1 * | 1/2003 | Phinney et al. | 271/262 |
| 6,520,498 | B2 * | 2/2003 | Phinney | 271/263 |
| 6,592,825 | B2 * | 7/2003 | Pelc et al. | 422/100 |
| 6,619,655 | B2 * | 9/2003 | Muller et al. | 271/152 |
| 6,691,578 | B1 * | 2/2004 | Puskas | 73/648 |
| 6,698,753 | B2 * | 3/2004 | Chujo et al. | 271/262 |
| 6,739,591 | B2 * | 5/2004 | Chujo et al. | 271/262 |
| 2001/0042956 | A1 * | 11/2001 | Minoru et al. | 271/265.04 |
| 2002/0007118 | A1 * | 1/2002 | Adachi et al. | 600/443 |

FOREIGN PATENT DOCUMENTS

JP 6-49567 12/1994

OTHER PUBLICATIONS

Patent Abstracts of Japan, Publication No. 10/257595, Publication Date; Sep. 25, 1998; Applicant: Murata MFG Co., Ltd., Inventor: Koichi Watanabe et al.

* cited by examiner

*Primary Examiner*—Patrick Mackey
*Assistant Examiner*—Jeremy R Severson
(74) *Attorney, Agent, or Firm*—Manabu Kanesaka

(57) ABSTRACT

A sheet feeding apparatus includes a stacker for stacking a sheet; a sheet separating device for sequentially separating and feeding the sheet stacked on the stacker; a sheet transport guide for guiding the sheet from the separating device to a processing position; and an ultrasonic wave sensor arranged between the separating device and the processing position for detecting the sheet. The ultrasonic wave sensor has a wave sending element for emitting an ultrasonic wave with a predetermined frequency and a wave receiving element for receiving the ultrasonic waves from the wave sending element. The wave sending element is arranged at a lower position in a direction of gravity relative to the sheet transport guide. The wave receiving element is arranged at an upper position opposite to the lower position, and has a wave sending surface inclined with an angle relative to a horizontal direction.

5 Claims, 11 Drawing Sheets

IMAGE READING APPARATUS

BACKGROUND OF THE INVENTION AND RELATED ART STATEMENT

The present invention relates to a sheet feeding apparatus for separating sheets stacked on a stacker into a single sheet and feeding the sheet to a processing position for reading an image on the sheet or printing the sheet. More particularly, the present invention relates to a sheet feeding apparatus provided with an ultrasonic wave sensor for detecting a sheet supplied to a processing position from a stacker or detecting a double feed of two or more sheets, and an image reading apparatus equipped with the same.

In an image reading apparatus such as a scanner or an image forming apparatus such as a printer, a sheet stacked on a stacker is picked up and transported to a predetermined processing position one at a time. The sheet is processed on a platen disposed at the processing position. In such an apparatus, it is necessary to accurately transport the sheet from the stacker to the platen in view of precise processing. Therefore, sensors are arranged along a sheet transport path for monitoring the sheet from the stacker to the processing position. The sensors include various types for detecting timing when a leading edge of the sheet reaches a specific position, timing when a trailing edge of the sheet passes, or detecting whether two or more sheets are transported, so that the sheet is properly transported thereafter.

Japanese Patent Publication (Kokai) No. 10-257595 has disclosed an ultrasonic sensor for detecting a transport process of a sheet. In a conventional ultrasonic wave sensor, a piezoelectric diaphragm such as a piezoelectric ceramic is disposed on a wave sending side (transmission side). A pulse voltage with a specific frequency is applied to the piezoelectric diaphragm, so that the piezoelectric diaphragm vibrates to generate an ultrasonic wave. A similar piezoelectric diaphragm is disposed at an opposing position across the sheet as a wave receiving side (reception side) for receiving the ultrasonic wave from the wave sending side to convert a vibration into an electrical signal. The electrical energy applied to the piezoelectric diaphragm at the wave sending side (wave sending element) is compared with the electrical energy generated in the piezoelectric diaphragm at the wave receiving side (wave receiving element), so that it is determined whether the sheet exists, or a plurality of sheets is overlapped.

In order to detect an overlapped state of sheets with such an ultrasonic wave sensor, it is necessary to accurately detect ultrasonic wave energy (output from a wave receiving element as electrical energy) attenuating through the sheets between the wave sending element and the wave receiving element. Further, in order to prevent an ultrasonic wave sent from the wave sending element from reflecting on the sheet and returning to the wave sending element to interfere with an incoming ultrasonic wave, U.S. Pat. No. 6,212,130 has disclosed a technique in which a wave sending element and a wave receiving element are inclined with a specific angle relative to a sheet.

Furthermore, Japanese Utility Model (Kokai) No. 06-49567 has disclosed a technique in which a wave sending element and a wave receiving element are disposed between front and back rollers arranged with a specific distance therebetween for detecting a sheet in a state that the sheet is transported linearly. That is, the front and back rollers nip and transport the sheet linearly when the sensor detects the sheet. Accordingly, it is possible to accurately detect the sheet even when a leading edge or a trailing edge of the sheet is bent or vibrates up and down. In order to detect a difference between a single sheet and a plurality of sheets with the ultrasonic wave or an amount of light transmitting through the sheet moving at a specific speed, it is necessary to reduce variation of the sheet and measure a predetermined length (area) of the sheet for smoothing.

As described above, in order to detect the sheet or the double feed of the sheets with an attenuation amount of the ultrasonic energy of the ultrasonic wave passing through the sheet, it is necessary to maintain the ultrasonic wave constant between the wave sending element and the wave receiving element. In this case, if dust such as paper dust is accumulated on a surface of the wave sending element or the wave receiving element, the ultrasonic wave may falsely attenuate due to the dust, thereby causing erroneous detection. In particular, when a plurality of sheets having different paper qualities and thicknesses is detected, even a small variation due to the dust may have a significant effect on the detection.

In view of the problems described above, an object of the present invention is to provide a sheet feeding apparatus having a simple structure with low cost in which an ultrasonic wave sensor can detect a sheet transported from a stacker without a large influence due to dust such as paper dust. Accordingly, it is possible to maintain detection accuracy regardless of environment or duration of use.

Further objects and advantages of the invention will be apparent from the following description of the invention.

SUMMARY OF THE INVENTION

To attain the aforementioned objects, according to the instant invention, a sheet feeding apparatus include separating means for sequentially separating a sheet stacked on a stacker, and a transport guide for feeding the sheet to a predetermined processing position for reading or printing. An ultrasonic wave sensor is disposed on the transport guide. The ultrasonic wave sensor is composed of a wave sending element for sending an ultrasonic wave having a predetermined frequency, and a wave receiving element for receiving the ultrasonic wave from the wave sending element. The wave sending element is arranged at a lower position and the wave receiving element is arranged at an upper position in a direction of gravity relative to the transport guide for guiding the sheet from the separating means to the processing position. The wave sending element is arranged such that a wave sending surface thereof is inclined so that a foreign matter falls off from the wave sending surface. With this structure, paper dust from the sheet passing over the transport guide falls onto the wave sending element, and the dust or foreign matter falls off from the inclined surface of the wave sending element.

In each of the wave sending element and the wave receiving element constituting the ultrasonic wave sensor, a piezoelectric diaphragm is disposed in a casing, so that a part of a surface of the casing forms a wave sending surface or a wave receiving surface. The wave sending element is connected to a high frequency oscillation circuit, and the wave receiving element is connected to an ultrasonic wave receiving circuit.

According to the present invention, the wave sending element and the wave receiving element may be inclined with a specific angle relative to a vertical line perpendicular to a direction that the transport guide transports the sheet, preferably between 30 degrees and 45 degrees. With this structure, it is possible to reduce a wave such as a standing wave due to interference when the ultrasonic wave from the wave sending element is reflected on the sheet and returns to the wave sending element. At the same time, when the transport guide is arranged in a horizontal direction or a substantially horizontal state, the surface of the wave sending element is inclined at an angle of 30 to 45 degrees relative to a direction of gravity (when the sheet is transported in a horizontal direction). Accordingly, it is possible to allow dust on the wave sending element surface to fall off. It is preferred to set the inclination angle of the wave sending surface through an experiment according to a frequency and amplitude of the ultrasonic wave so that dust on the surface falls off by vibration of the ultrasonic wave.

According to the present invention, power may be supplied to the high frequency oscillation circuit so that the wave sending element vibrates after an initialization or a job of the apparatus. Accordingly, it is possible to forcefully remove dust or dirt from the surface of the wave sending element, thereby cleaning the surface. In this case, the ultrasonic wave has amplitude greater than that for detecting in a normal state, thereby obtaining higher efficacy.

According to the present invention, an image reading apparatus is provided with the ultrasonic wave sensor described above between the sheet separating means and a platen for reading images on the sheets. It is preferable that the wave sending element and the wave receiving element are arranged between the separating means and register means where a sheet temporarily stays after leaving the separating means. With this structure, it is possible to detect a double feed of the sheets before the sheets reach the register means that feeds the sheets to the platen.

According to the present invention, the wave sending element and the wave receiving element may be arranged at opposing positions on the transport guide that guides the sheets from the stacker to the processing position. The wave sending element is disposed at a lower position and the wave receiving element is disposed at an upper position in the direction of gravity. With this structure, dust and dirt generated from the sheet moving along the transport guide fall onto the wave sending surface of the wave sending element. Accordingly, it is possible to reduce an effect of dust on detection accuracy as opposed to a case that dust or dirt is accumulated on the wave receiving surface. Furthermore, the wave sending surface of the wave sending element is inclined, so that dust further falls off from the wave sending surface, thereby further improving detection accuracy.

In the present invention, it is possible to reliably detect the sheet without an effect of dust or dirt generated during the transport of the sheets on the detection of the sheet or the double feed. In particular, it is possible to effectively detect the double feed of two or more sheets.

DETAILED DESCRIPTION OF PREFERRED EMBODIMENTS

Hereunder, preferred embodiments of the invention will be explained with reference to the accompanied drawings. According to the present invention, when an original or a sheet is transported to an image reading apparatus such as a scanner or an image forming apparatus such as a printer or copier, an ultrasonic wave sensor detects whether the sheet is correctly separated into a single sheet from the stacker and is correctly transported to a processing unit (processing platen), or whether more than two sheets are transported in an erroneous state (double feed), thereby properly processing the sheet at the processing platen.

Figure 1:
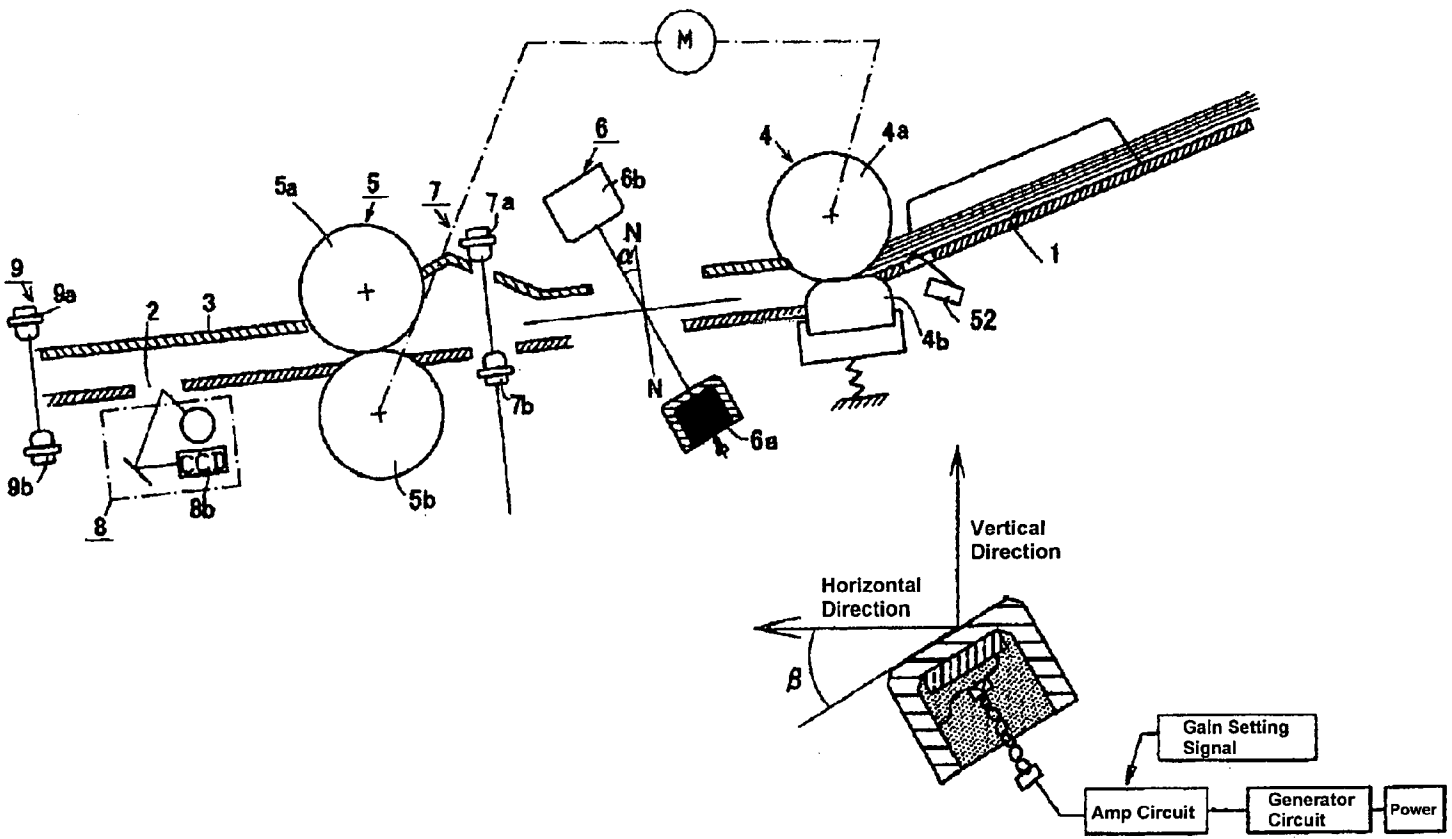
FIG. 1 is a schematic view showing a mechanism of a sheet feeding apparatus according to an embodiment of the present invention.
Figure 2D:
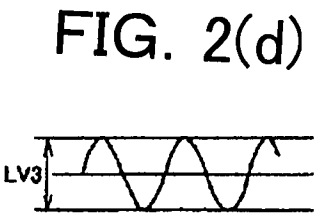
FIGS. 2(*a*) to 2(*d*) are views showing waveforms of ultrasonic waves, and FIG. 2(*e*) is a view showing a structure of an ultrasonic wave sensor in the sheet feeding apparatus shown in FIG. 1.
Figure 2C:
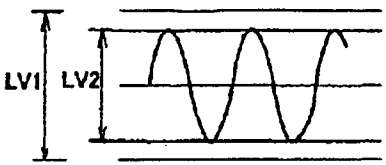
Figure 2B:
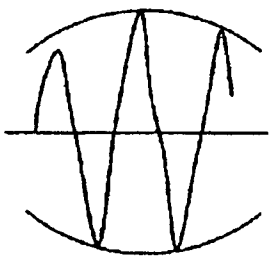
Figure 2A:
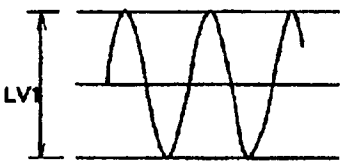
Figure 2E:
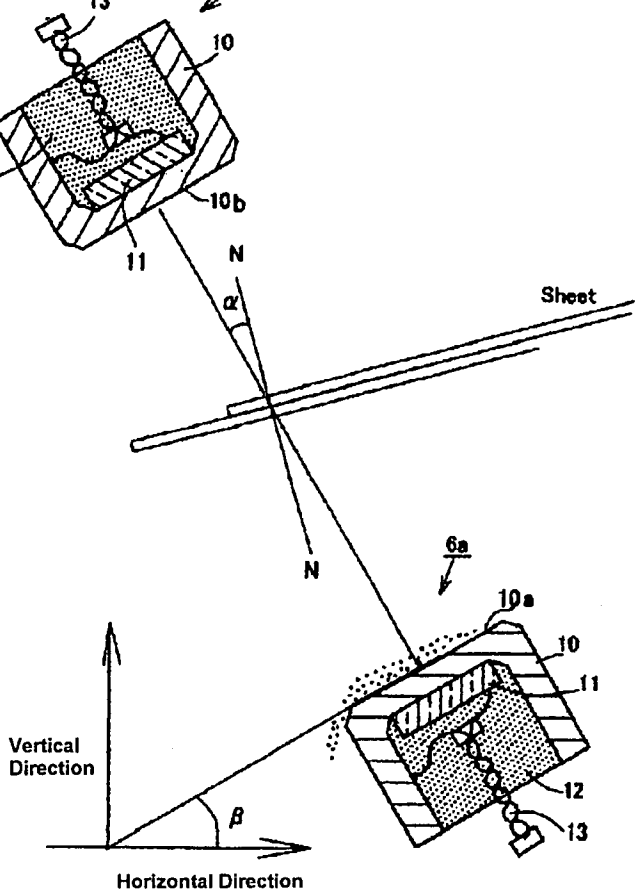
Figure 3:
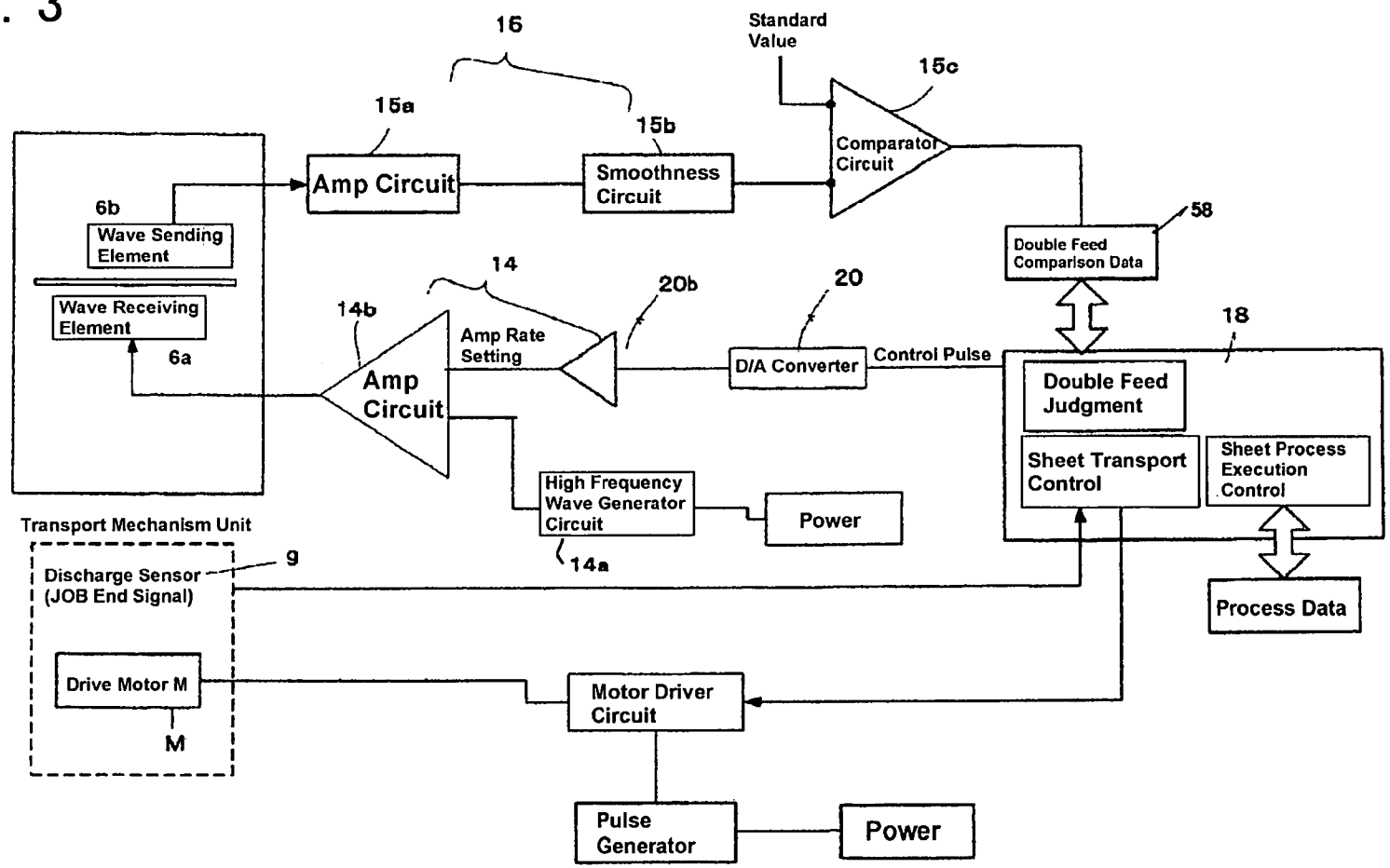
FIG. 3 is a block diagram showing a control circuit of the sheet feeding apparatus shown in FIG. 1.
Figure 4:
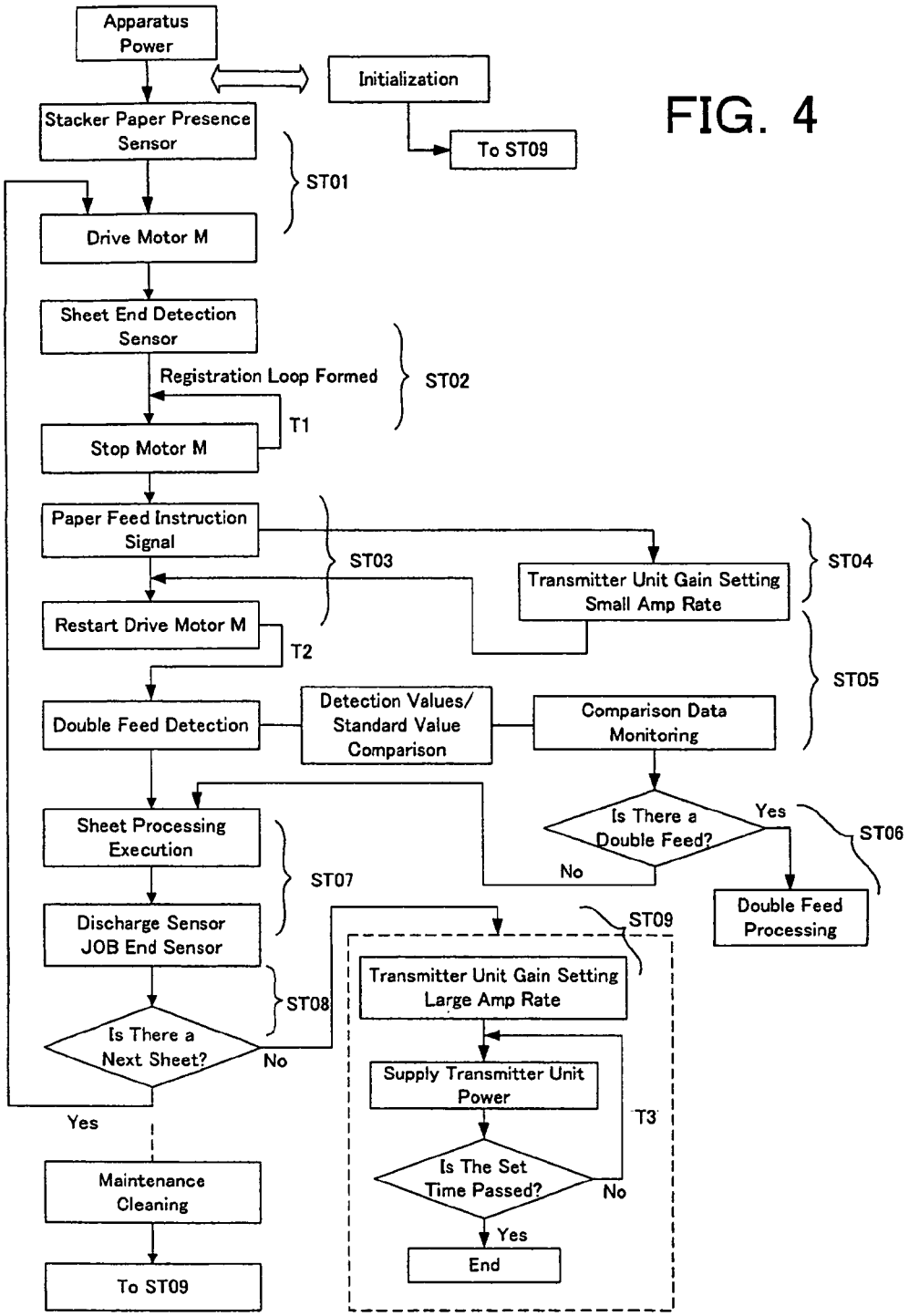
FIG. 4 is a flow chart for explaining a control of the sheet feeding apparatus shown in FIG. 1.

FIG. 1 shows an essential structure of an image reading apparatus (described below) in which an ultrasonic wave sensor is mounted to a transport guide of the image reading apparatus. FIG. 2(*e*) shows a schematic configuration of an example of the ultrasonic wave sensor. FIG. 3 shows a control circuit. FIG. 4 is a flow chart for explaining an operation of transporting a sheet in a sheet feeding apparatus.

As shown in FIG. 1, a sheet feeding apparatus is equipped with a stacker 1 for stacking sheets; separating means 4 for separating and feeding the sheets on the stacker 1; a transport guide 3 for guiding the sheets from the separating means 4 to a processing platen 2; and an ultrasonic wave sensor 6 arranged on the transport guide 3. The separating means 4 is formed of a separating roller 4*a* for sequentially picking up the sheets on the stacker 1, and a friction pad 4*b* touching the separating roller 4*a*. A variety of separating means are known in the art. Instead of the separating roller 4*a*, a belt may be employed. Instead of the friction pad 4*b*, a reverse-rotating roller or a belt may be employed. The transport guide 3 is composed of plate members for guiding the sheets and forms a transport path for guiding the sheets to the processing platen 2. The processing platen 2 is composed of a transparent glass plate for supporting the sheet so that images on the sheet are read or images are printed on the sheet. The platen 2 is provided with image reading means 8, and light from a light source 8*a* is reflected on the sheet and electrically read by a photoelectric converting element 8*b*.

As shown in FIG. 1, sheet detection sensors 7 and 9 detect the sheets moving over the transport guide 3. Light receiving elements 7*b* and 9*b* receive light from light emitting elements 7*a* and 9*a* such as a photodiode to detect a leading edge or a trailing edge of the sheet. The sheet detection sensor 7 controls register correction in which the leading edge of the sheet abuts against register roller 5 to form a loop, so that the leading edge of the sheet is aligned. The sheet detection sensor 9 is arranged in front of a discharge stacker (not shown) for detecting the trailing edge of the sheet to determine that a process (job) is completed.

A configuration of the ultrasonic wave sensor 6 will be explained with reference to FIG. 2(*e*). In general, the ultrasonic wave sensor is composed of a wave sending element 6*a* and a wave receiving element 6*b* having a same structure, in which a piezoelectric diaphragm 11 such as a piezoelectric ceramic plate is disposed in an elastic plastic 12 in a casing 10 made of metal. The piezoelectric diaphragm 11 is provided with electrodes deposited on front and back surfaces thereof, and a lead wire 13 supplies high frequency power to the electrodes. The piezoelectric diaphragm 11 is integrally attached to the casing 10, so that the piezoelectric diaphragm 11 and the casing 10 vibrate together at a specific frequency according to a characteristic frequency to send an ultrasonic wave outwardly from a wave sending surface 10*a* constituting a part of the casing. One end of the lead wire 13 is grounded to the casing 10.

When high frequency power is supplied to the wave sending element 6*a* through the lead wire 13, the piezoelectric diaphragm 11 and the casing 10 attached thereto vibrate at a specific frequency for emitting the ultrasonic wave from the wave sending surface 10*a*. The wave receiving surface 10*b* of the casing 10 and the piezoelectric diaphragm 11 integrated therewith receive the ultrasonic wave so that the wave receiving element 6*b* resonates. Accordingly, the piezoelectric diaphragm 11 generates electrical energy to be output from the electrode via the lead wire 13.

The ultrasonic wave sensor 6 having the structure described above is arranged on the transport guide 3, and connected to an oscillation circuit 14 and a receiving circuit 15 as shown in FIG. 3. The oscillation circuit 14 is composed of a high frequency oscillation circuit or a high frequency wave generation circuit 14*a* and a power amplifier circuit or an amp circuit 14*b*. The receiving circuit 15 is composed of an amplifier circuit or an amp circuit 15*a* and a smoothing circuit or a smoothness circuit 15*b* formed of transistors. The high frequency oscillation circuit 14*a* generates a high-frequency voltage, for example, 30 KHz to 40 KHz. The voltage or signal is amplified by an inverter and applied to the electrodes formed on the front and back surfaces of the piezoelectric diaphragm 11, so that the piezoelectric diaphragm 11 is excited.

The ultrasonic wave excites the piezoelectric diaphragm 11 of the wave receiving element through the sheet and outputs an electrical signal. The electrical signal from the wave receiving element 6*b* is amplified by a transistor. After being rectified at the smoothing circuit 15*b*, the electrical signal is smoothed at an integrated circuit such as a condenser, so that the electrical signal is compared with a predetermined standard value to detect the double feed of the sheets.

As described above, when power is supplied to the high frequency oscillation circuit 14*a*, the piezoelectric diaphragm 11 on the wave sending element 6*a* generates the ultrasonic wave having a specific frequency. The piezoelectric diaphragm 11 generates the ultrasonic wave having constant amplitude (output level LV1) as shown in FIG. 2(*a*). The wave receiving element 6*b* opposite to the wave sending element 6*a* receives the ultrasonic waves passing through the sheet. As a result, the piezoelectric diaphragm 11 of the wave receiving element 6*b* resonates, thereby outputting electrical energy generated by the vibration. When the ultrasonic wave passes through the sheet, the ultrasonic wave is attenuated differently in a case of one sheet (output level LV2) as shown in FIG. 2(*b*) and in a case of two or more sheets (output level LV3) as shown in FIG. 2(*c*).

Figure 6A:
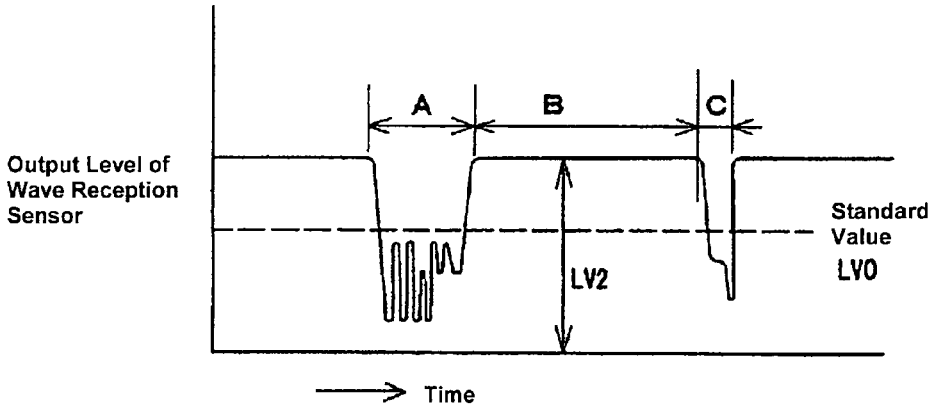
FIG. 6(*a*) and FIG. 6(*b*) are views showing waveforms of signals output from the ultrasonic wave sensor shown in FIG. 2(*e*)
Figure 6B:
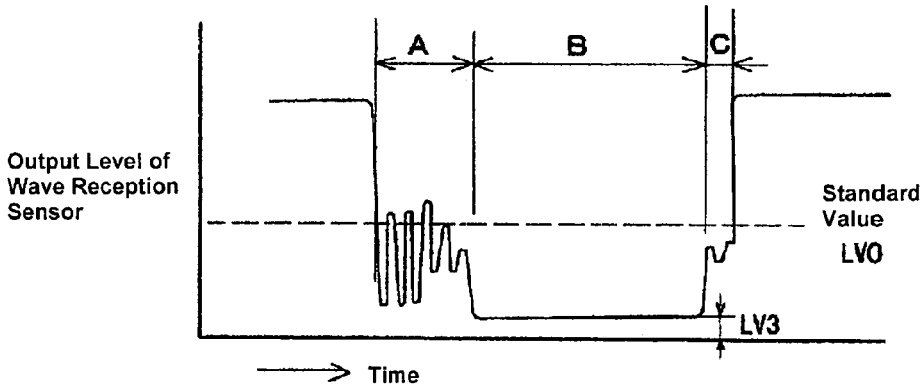

The electrical energy having the waveforms shown in FIG. 2(*b*) and FIG. 2(*c*) is processed with the amplifier circuit 15*a* and the smoothing circuit 15*b*. Specifically, after being amplified, the electrical energy output from the wave receiving element 6*b* is rectified and converted to output levels with the smoothing circuit 15 composed of an integrated circuit as shown in FIG. 6(*a*) and FIG. 6(*b*). FIG. 6(*a*) is a chart showing the output level LV2 in the case that one sheet is transported. Before the leading edge of the sheet reaches the register rollers 5*a* and 5*b*, the detection signal is disturbed as shown as a portion A in the chart. When the separating roller 4*a* and the register rollers 5*a* and 5*b* nip the sheet, the detection signal becomes stable as shown as a portion B. When the trailing edge of the sheet is released from the separating roller 4*a* (passing through the rollers), the detection signal is disturbed again as shown as a portion C. FIG. 6(*b*) is a chart showing the output level LV3 in the case that two or more sheets are transported. The portions A, B, and C represent events same as those described above.

When a standard value is set at a level LV0 indicated by a hidden line in FIGS. 6(*a*) and 6(*b*), the B portion has a relationship of LV1>LV2>LV0>LV3. Accordingly, it is possible to determine whether the single sheet is transported as shown in FIG. 6(*a*), or two or more sheets are transported as shown in FIG. 6(*b*). In the operation, the signal output from the smoothing circuit 15*b* is compared with the standard value (LV0) with a comparator circuit (means) 15*c* such as a converter. The standard value is determined as follows. First, conditions such as a paper thickness, paper quality, and a transport speed are determined based on environment of the apparatus. Then, a boundary value between the output levels of the wave receiving sensor in the cases of transporting one sheet and two or more sheets is determined through experiment according to the conditions, and the boundary value is used as the standard value.

The standard value in the cases of transporting one sheet and two or more sheets is set as described above. When the standard value is set to a boundary value between a case of transporting the sheet and a case of not transporting the sheet, it is possible to detect a leading edge and a trailing edge of the sheet. Furthermore, when the standard value has several settings for cases of transporting one sheet, two sheets, and more sheets, it is possible to determine the number of the sheets.

The high frequency oscillation circuit 14*a* supplies the high-frequency voltage to the wave sending an element 6*a* instantaneously to generate a burst wave, or supplies electrical power to the wave sending an element 6*a* continuously to generate a standing wave. In the case of the burst wave, the output from the wave receiving element 6*b* tends to be unstable (fluctuating with an environmental condition) depending on an overlapped state of the sheets, so that it is preferred to detect intermittently several times.

An arrangement of the ultrasonic wave sensor having the structure described above will be explained next. The wave sending element 6*a* and the wave receiving element 6*b* are arranged on the sheet transport guide 3 as follows. The wave sending element 6*a* and the wave receiving element 6*b* are arranged to face with each other with a predetermined angle relative to the sheet passing along the transport guide 3. As shown in FIG. 1, the wave sending element 6*a* and the wave receiving element 6*b* are inclined with an angle $\alpha$ relative to a straight line N—N perpendicular to the transport guide 3. In FIG. 1, the angle $\alpha$ relative to the wave sending element 6*a* is between 30 degrees and 45 degrees. Accordingly, it is possible to prevent the ultrasonic wave sent from the wave sending element 6*a* from colliding with the ultrasonic wave reflected from the sheet surface and returning to the wave sending element 6*a* (wave sending surface). It is also to prevent the similar interference between the sheet surface and the wave receiving surface 10*a* of the wave receiving element 6*b*. The angle α is set according to a distance from the sheet to the wave sending (receiving) surface and an area of the wave sending (receiving) surface.

The wave sending element is arranged at a lower position in a direction of gravity relative to the transport guide 3, and the wave receiving element is arranged at an upper position. The wave sending surface of the wave sending element 6*a* vibrates at the output level (LV1) greater than that of the wave receiving element 6*b* as described above. Also, in order to determine the difference in resonance levels (intensity of the vibrations) of the wave receiving surface in the cases of transporting one sheet and two or more sheets, it is necessary to reduce an external effect on the wave receiving surface. For this reason, the wave sending element 6*a* is arranged at a lower position and the wave receiving element 6*b* at an upper position in the direction of gravity, thereby reducing an effect of paper dust falling from the sheet transport guide on detection accuracy.

The wave sending surface 10*a* of the wave sending element 6*a* at the lower position is inclined with a predetermined angle β relative to a horizontal direction. The angle β is selected such that paper dust falls off from the wave sending surface 10*a* of the wave sending element 6*a* naturally or in cooperation with the vibration of the ultrasonic wave. The angle β shown in FIG. 1 is set to 30 degrees, and may be preferred to be close to 90 degrees.

It is controlled to adjust power supplied to the wave sending element 6*a* at large and small amplitudes. When the detection is not performed, i.e. the apparatus is starting up or a job is completed, high frequency power having amplitude larger than that when the detection is performed is supplied to the wave sending element 6*a*. Accordingly, the wave sending element 6*a* is excited and vibrates with amplitude greater than normal, thereby falling dust on the wave sending surface together with the inclined arrangement. A gain (amplifier rate) of the amplifier circuit 14*b* for amplifying power from the oscillation circuit 14*a* is controlled to adjust the amplitude. Furthermore, when the detection is not performed, the wave sending surface 10*a* is preferably excited with the burst wave of the ultrasonic wave to effectively remove dust.

When the amplifier rate of the amplifier circuit 14*b* is controlled, an 8-bit voltage signal is output from the control CPU 18, and the digital signal is converted into an analog signal with a D/A converter 20 (see FIG. 3). In the embodiment, the amplifier rate is set in advance such that the D/A converter 20 outputs a direct current of 0 V to 5 V and a non-inverting amplifier circuit 20*b* amplifies the voltage to between 0 V and 12 V. Note that 12 V is the maximum rated voltage for the ultrasonic wave element (wave sending element). The oscillation circuit 14*a* outputs a rectangular voltage of 12 V and a frequency of 220 KHz to the amplifier circuit 14*b*, i.e. a differential amplifier circuit, and the rectangular voltage amplified with the amplifier circuit 14*b* is supplied to the wave sending element 6*a*. Accordingly, it is possible to change the voltage of the amplifier circuit 14*b* by increasing or decreasing the digital signal supplied from the control CPU 18 to the D/A converter 20.

Figure 5:
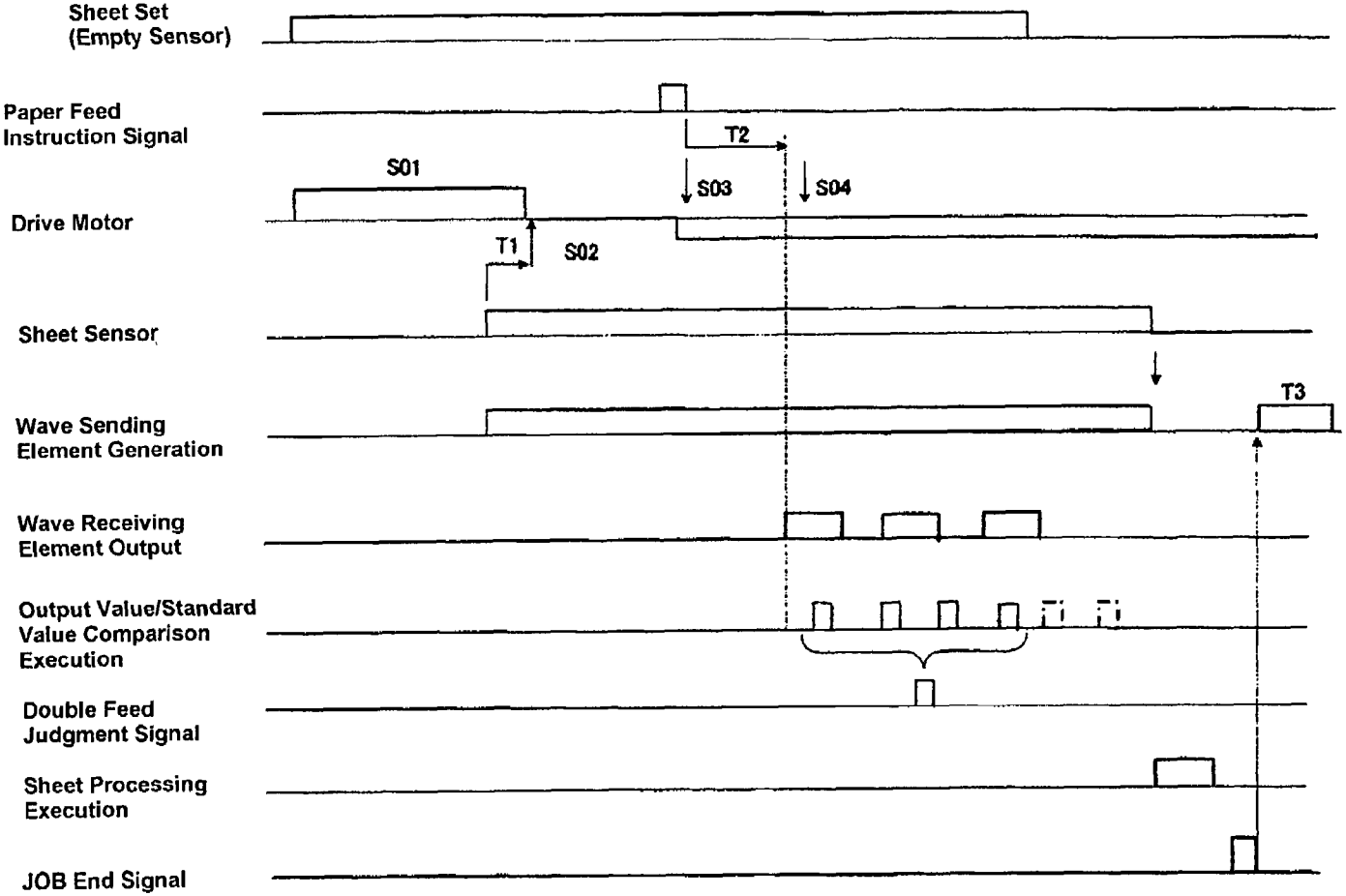
FIG. 5 is a timing chart for explaining the control of the sheet feeding apparatus shown in FIG. 1.

FIG. 4 is a flow chart and FIG. 5 is a timing chart for explaining a control of the sheet feeding apparatus shown in FIG. 1. In FIG. 4, when the apparatus is turned on, the control CPU 18 determines whether the sheet is on the stacker 1 with an empty sensor 52, and the drive motor M rotates in the forward rotation upon a detection signal of the empty sensor 52 (S01). With the forward rotation of the drive motor M, the separating roller 4*a* rotates in a clockwise direction, and the register roller 5*a* stays in a stationary state. The separating roller 4*a* rotates to feed the sheet on the stacker 1 toward the left side in FIG. 1 until the sheet reaches the register roller 5*a* through the ultrasonic sensor 6 and the sheet detection sensor 7.

When the sheet detection sensor 7 detects the leading edge of the sheet, the timer T1 starts (S02). After the leading edge of the sheet reaches the register roller 5*a* and the separating roller 4*a* rotates to form a loop in the sheet, the timer T1 sends a stop signal to stop the drive motor M (ST02 in FIG. 4).

When a processing apparatus such as an image reading apparatus sends a paper feed instruction signal S03, the drive motor M rotates in reverse and the timer T2 starts. At the same time, the control CPU 18 turns on the oscillation circuit 14 of the ultrasonic wave sensor upon the paper feed instruction signal S03. When the drive motor M rotates in reverse, the register roller 5*a* rotates in the clockwise direction to feed the sheet to the processing platen 2. At this time, the separating roller 4*a* stays in a stationary state. After the loop in the leading edge of the sheet is removed and the sheet is supported in a straight line by the separating roller 4*a* and the register roller 5*a*, the timer T2 sends a double feed detection start signal S04 (STO3 in FIG. 4) The timers Ti and T2 are formed of delay circuits that count a standard clock in the control CPU 18 using a counter.

Upon the paper feed instruction signal (S03) from the main apparatus, the control CPU 18 sets the amplifier rate of the amplifier circuit 14*b* of the oscillation circuit 14. The amplifier rate is transmitted to the amplifier circuit 14*b* from the control CPU 18 via the D/A converter 20 in the following way.

The control CPU 18 supplies a rectangular wave voltage continuously to the non-inverting amplifier circuit 20*b*, and the wave sending element 6*a* continuously generates the ultrasonic wave having a predetermined frequency via the amplifier circuit 14*b*. The control CPU 18 is arranged such that an appropriate value (amplifier rate) below 12 V is supplied.

In FIG. 4, upon the paper feed instruction signal S03, the timer T2 starts and the drive motor M is started to feed the sheet toward the processing platen 2. The timer T2 is set at an estimated time for the register roller 5 to send the sheet for a length of a loop for the register correction of the leading edge of the sheet. When the timer stops, the double feed detection starts. At this time, power is already supplied to the wave sending element 6*a* to generate the ultrasonic wave in a stable manner. The ultrasonic wave passes through the sheet and is received by the wave receiving element 6*b* at the opposing position. An output corresponding to a state of the sheet is compared with a preset standard value at the comparator circuit 15*c* through the amplifier circuit 15*a* and the smoothing circuit 15*b* (ST05 in FIG. 4).

A comparison result is stored in a register and transferred to a judgment circuit in the control CPU 18. When the timer T2 stops and the double feed detection start signal S04 is received, the control CPU 18 clears data in the register. When the register roller 5 transports the sheet, the comparison result compared with the comparator circuit 15*c* is sequentially sent to the register and the control CPU 18 uses the comparison result to determine the double feed of the sheets.

When the judgment circuit of the control CPU determines the double feed, a double feed process is executed (ST06). In the double feed process, a trouble signal is sent to the main apparatus such as an image reading apparatus to stop the operation. At the same time, a warning is displayed on a display of a control panel to notify an operator. Also, in the double feed process, information such as a page order of the sheets is stored and the process of the next sheet continues as is. When the processing of all sheets is completed, the information is displayed and the operator executes the processing one more time for correction.

When the judgment circuit does not detect the double feed, the sheet is processed at the processing platen 2 (ST07). When the sheet processed at the processing platen 2 is transported to the discharge stacker, the sheet detection sensor 9 disposed in front of the discharge stacker detects the trailing edge of the sheet (ST08). When the control CPU 18 receives the detection signal from the sheet-detection sensor 9 and the empty sensor 54 detects the next sheet on the stacker 1, step ST01 is repeated to process the next sheet in the same way. When the empty sensor 54 detects no sheet on the stacker 1, the job is completed and the cleaning operation is performed as described below.

The control CPU 18 sends a gain setting command to the amplifier circuit 14*b* of the oscillation circuit 14 upon receiving the job end signal. In setting the gain, the control CPU 18 intermittently supplies the rectangular wave voltage, so that the wave sending element 6*a* generates the burst wave with a specific frequency via the amplifier circuit 14*b*. The burst wave has amplitude larger than that of the continuous wave for detecting the double feed. In the embodiment, a voltage below 12 V is supplied for generating the continuous wave, and a voltage just below 50 V is supplied for generating the burst wave. After the gain is set, power is supplied to the high frequency wave oscillation circuit 14*a*, and the power is turned off after a specific period of time of the timer T3 to complete the operation.

In the embodiment of the present invention, the cleaning operation is executed upon the job end signal. The cleaning operation may be executed when the apparatus is turned on or is initialized (see hidden lines in FIG. 4). In that case, the operation is executed upon an initialize starting signal generated when the apparatus is turned on. Also, the cleaning operation may be executed when maintenance of the apparatus is performed. In this case, a cleaning button may be provided on an operation panel of the apparatus, and the cleaning is executed by pressing the button.

Figure 7:
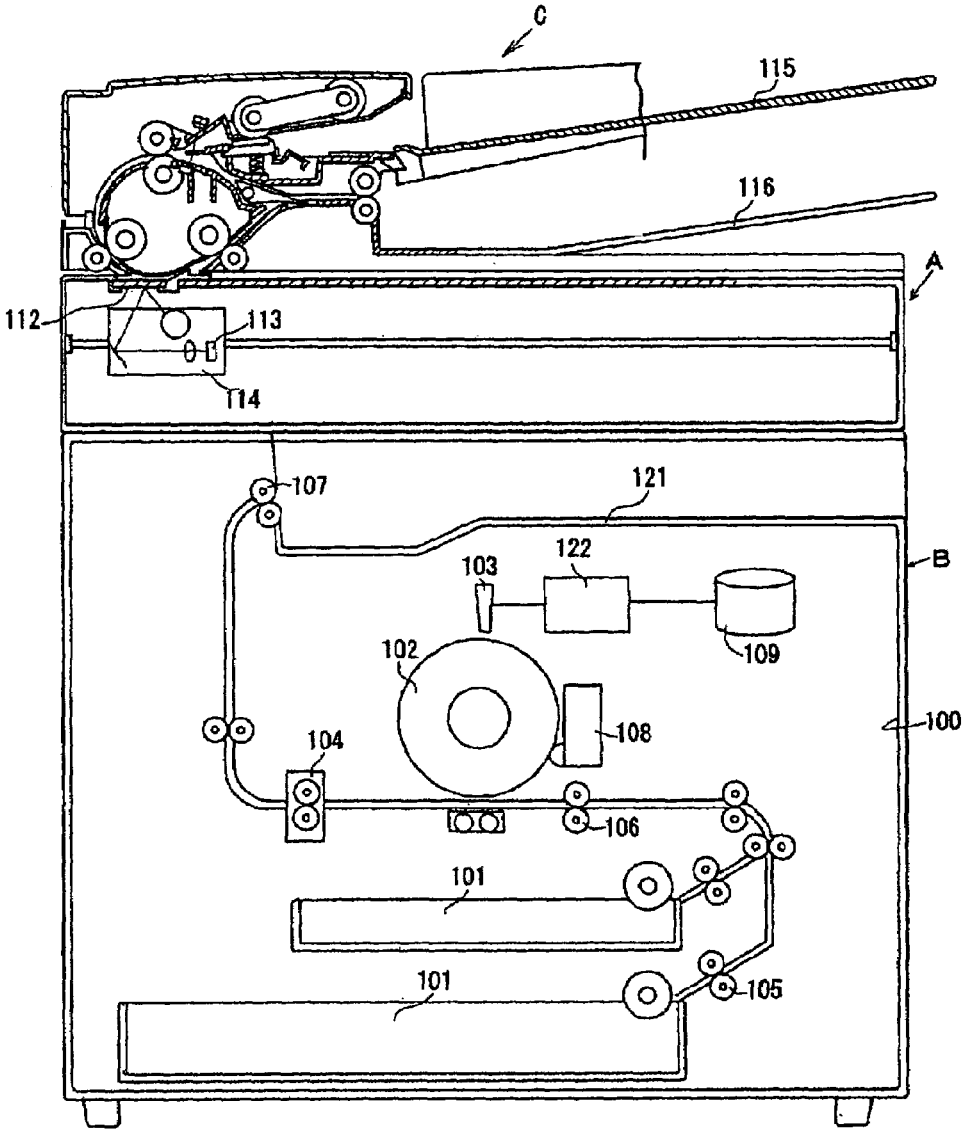
FIG. 7 is a view showing an image reading apparatus and an image forming apparatus equipped with the same as a unit according to an embodiment of the present invention.
Figure 8:
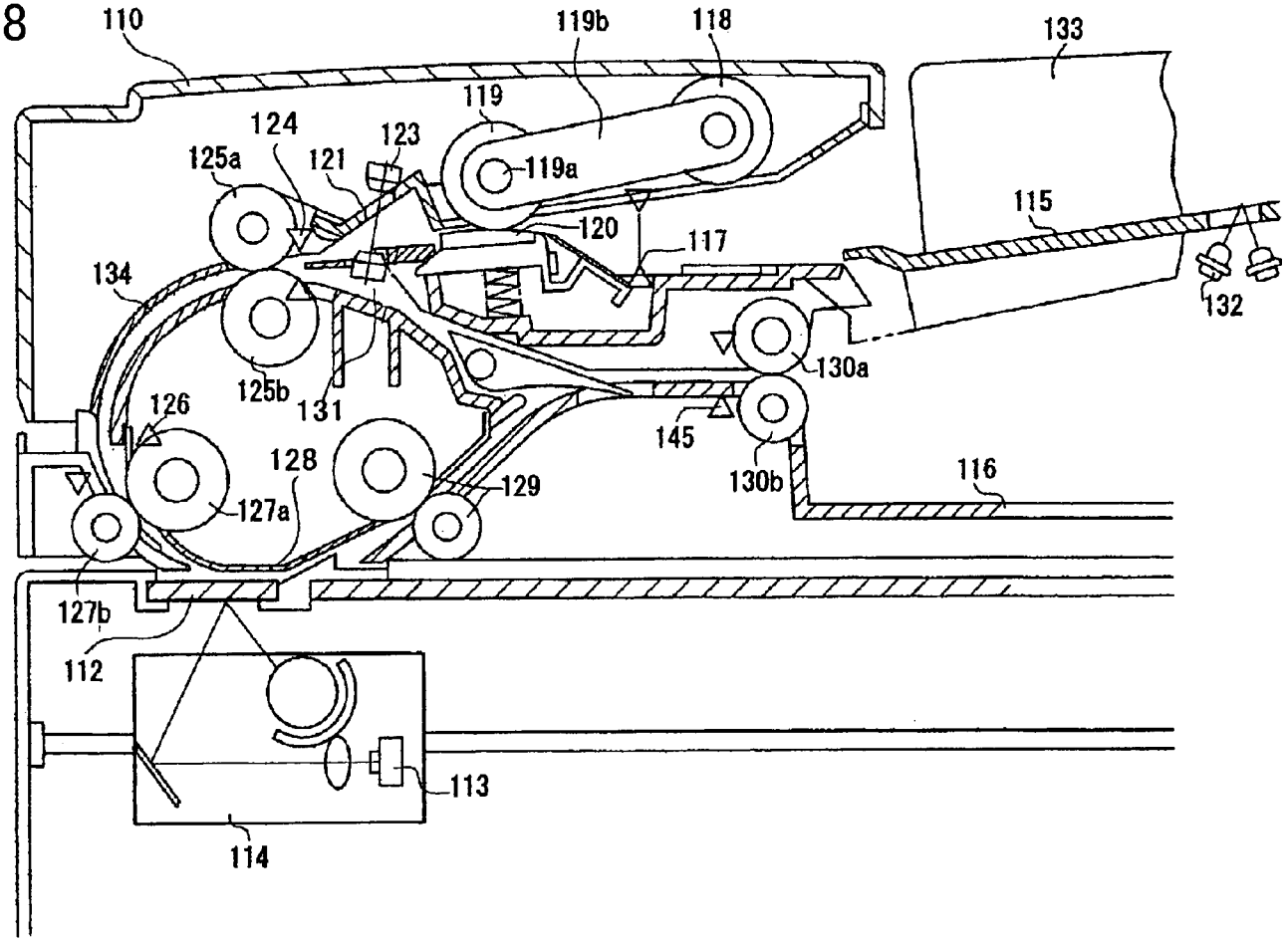
FIG. 8 is a detailed view showing a sheet supply unit of the image forming apparatus shown in FIG. 7.

An image reading apparatus according to an embodiment of the present invention will be explained next. FIG. 7 shows a general structure of an image reading apparatus A and an image forming apparatus B provided with the image reading apparatus A as a unit. FIG. 8 shows a detailed structure of a sheet feeding unit in the image forming apparatus B. The image forming apparatus B provided with the image reading apparatus A includes a print drum 102 disposed inside a casing 100; a paper feed cassette 101 for feeding the sheet to a print drum 102; a developer 108 for forming images on the print drum 102 using toner; and a fixer 104. A print head 103 such as a laser is provided for forming latent images on the print drum 102. Transport rollers 105 feeds the sheet from the paper feed cassette 101 to the print drum 102 where images formed by the print head 103 are transferred to the sheet and fixed thereupon by the fixer 104. The sheets with the images are stored in a discharge stacker 121 from the discharge roller 107.

The image forming apparatus B such as a printer is composed of a paper feed unit, a printing unit, and a discharge storage unit having various functions. The image forming apparatus B is not limited to the structure described above, and may include, for example, an inkjet printer and a silkscreen printer. The print head 103 is electrically connected to a memory apparatus 122 such as a hard disk for storing image data and a data control circuit 109 for sequentially transferring the image data to the print head. The image reading apparatus A is mounted on an upper portion of the image forming apparatus B as a unit. The image reading apparatus A is provided with a platen 112 attached to a casing 110. An optical mechanism 114 and a photoelectric converting element 113 are arranged for reading an original through the platen. CCD is widely known and used for the photoelectric converting element 113.

A sheet feeding apparatus C shown in FIG. 7 is installed on the platen 112. In the sheet feeding apparatus C, a paper feed stacker 115 and a discharge stacker 116 are arranged vertically above the platen 112. The sheet is guided from the paper feed stacker 115 to the discharge stacker 116 via a U-shaped transport path 134 through the platen 112. An empty sensor 117 and a size sensor 132 are arranged on the paper feed stacker 115 for detecting the sheet on the stacker. A side guide 133 is provided for aligning side edges of the sheet.

A separating roller 119 and a stationary pad 120 contacting the separating roller are arranged at an upstream side of the paper feed stacker 115. A kick roller 118 is mounted on a bracket 119*b* attached to a rotating shaft 119*a* of the separating roller 119. When the rotating shaft 119*a* rotates in a clockwise direction, the kick roller 118 lowers to a position above the paper feed stacker 115. When the rotating shaft 119*a* rotates in a counterclockwise direction, the kick roller 118 rises to a state shown in the drawing (described below). An ultrasonic sensor 123 for detecting the double feed of the sheets and sheet edge detection means 124 for detecting the leading edge and the trailing edge of the sheet are arranged in the transport path 134 at a downstream side of the separating roller 119. There are arranged on the transport guide 134 register rollers 125*a* and 125*b*; feed rollers 127*a* and 127*b*; transport roller 129; and discharge rollers 130*a* and 130*b* in this order for transporting the sheets from the paper feed stacker 115 to the discharge stacker 116. As shown in FIG. 8, reference numeral 126 represents a lead sensor for detecting the leading edge of the sheet, and reference numeral 128 represents a guide for supporting the sheets at the platen 112. Also, reference numeral 131 represents a circulating path for circulating the sheet from the platen 112 to the register rollers 125*a* and 125*b* through a path switching gate 131*a*.

Figure 9A:
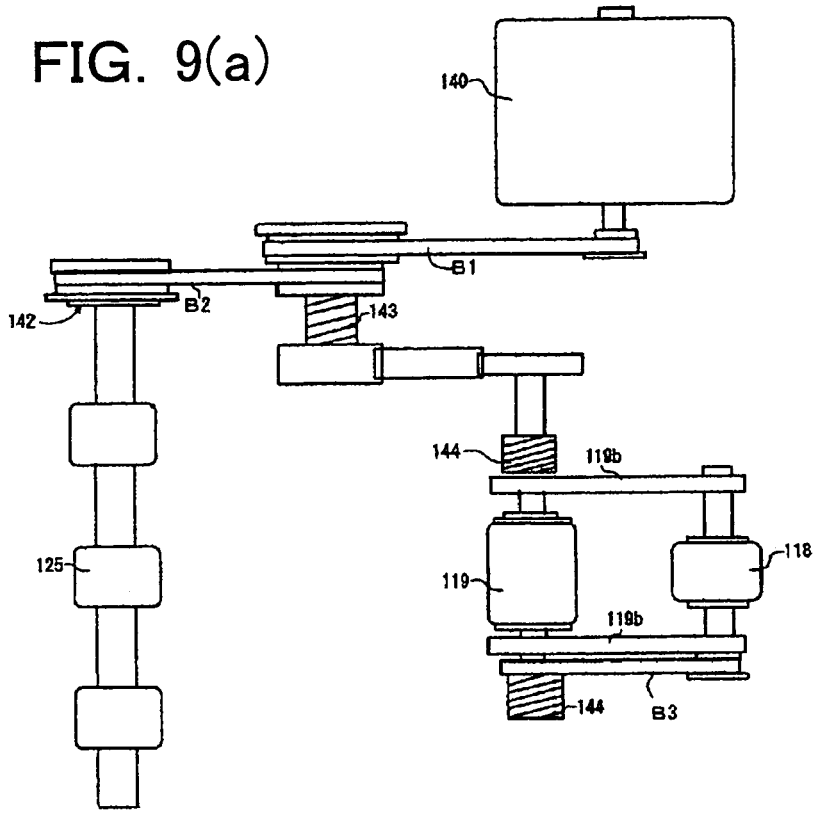
FIG. 9(*a*) and FIG. 9(*b*) are views showing a drive mechanism of the image forming apparatus shown in FIG. 7.
Figure 9B:
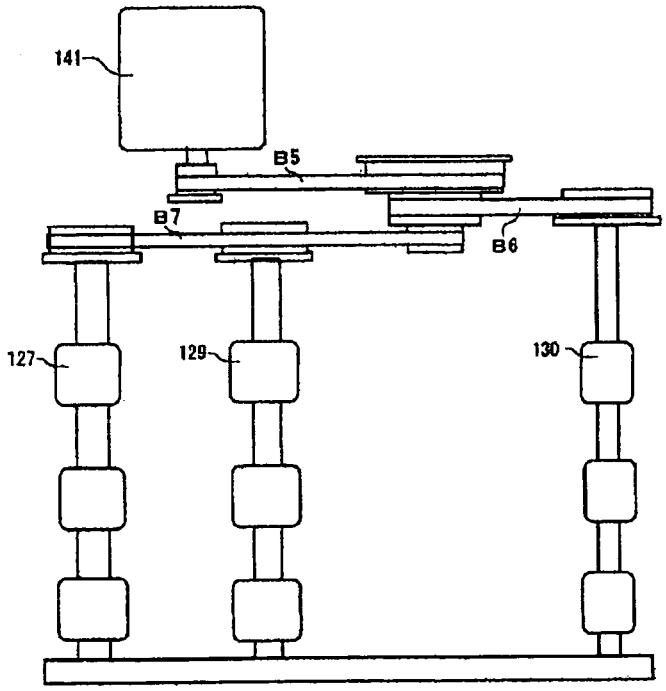

FIG. 9(*a*) and FIG. 9(*b*) are views showing a drive mechanism of the separating roller 19 and the register rollers 125. A paper feed drive motor 140 is capable of forward and reverse rotations, and drives the kick roller 118, the separating roller 119, and the register rollers 125. A transport drive motor 141 drives the paper feed roller 127, the transport out roller 139, and the discharge roller 130. The paper feed drive motor 140 rotates forward to drive the kick roller 118 and the separating roller 119, and rotates in reverse to drive the register roller 125. The paper feed drive motor 140 controls the kick roller 118 to rise and lower. The paper feed drive motor 140 transmits rotation only in one direction to the register rollers 125 through a one-way clutch 142 via the belts B1 and B2. The paper feed drive motor is connected to the rotating shaft of the separating roller 119 through the one-way clutch 143, so that the one-way clutches 142 and 143 are driven relatively.

The bracket 119*b* is supported on the rotating shaft of the separating roller 119 via the spring clutch 144. A transmission belt B3 transmits drive to the kick roller 118 mounted on the bracket 119*b*. When the paper feed drive motor 140 rotates forward, the rotational drive is transmitted to the separating roller 119 and the kick roller 118. Simultaneously, a spring of the spring clutch 144 becomes loose to release the bracket 119*b*, so that the kick roller 118 lowers from the retracted position shown in FIG. 8 to touch the sheet on the stacker. When the paper feed drive motor 140 rotates in reverse, the rotational drive is transmitted to the register rollers 125. Simultaneously, the spring clutch 144 contracts to raise the bracket 119*b*, so that the kick roller 118 returns to the retracted position shown in FIG. 8.

As shown in FIG. 9(*a*), the transport unit drive motor 141 is connected to the feed rollers 127, transport rollers 129, and discharge rollers 130 via belts B5, B6 and B7. The feed rollers 127 and transport rollers 129 always rotate in one direction with the forward or reverse rotation of the motor through a one-way clutch. The discharge rollers 130 rotate forward or in reverse with the forward or reverse rotation of the motor.

The transport path 134 is provided with sensors for detecting the leading edge of the sheet. A plurality of size sensors 132 is arranged on the paper feed stacker 115 for detecting a size of the sheet to control transport of the next sheet. The empty sensor 117 is disposed at a leading end of the paper feed stacker 115 for detecting the sheets on the stacker. When the empty sensor 117 detects a last sheet, a signal is sent to the processing apparatus such as the image reading apparatus A. The ultrasonic wave sensor 123 described above and the sheet edge detection sensor 124 are disposed at a downstream side of the separating roller 119.

A lead sensor 126 is disposed in front of the paper feed roller 127 for detecting the leading edge of the sheet, so that the image reading apparatus calculates a starting line for printing or reading the images. After the paper feed instruction signal is sent from the register rollers 125, when the sheet is not detected for a predetermined period of time, the drive motor stops as a jam and sends a warning signal. A discharge sensor 145 is disposed at a downstream side of the transport rollers 129 for detecting the leading edge and the trailing edge of the sheet to determine a jam.

Figure 10:
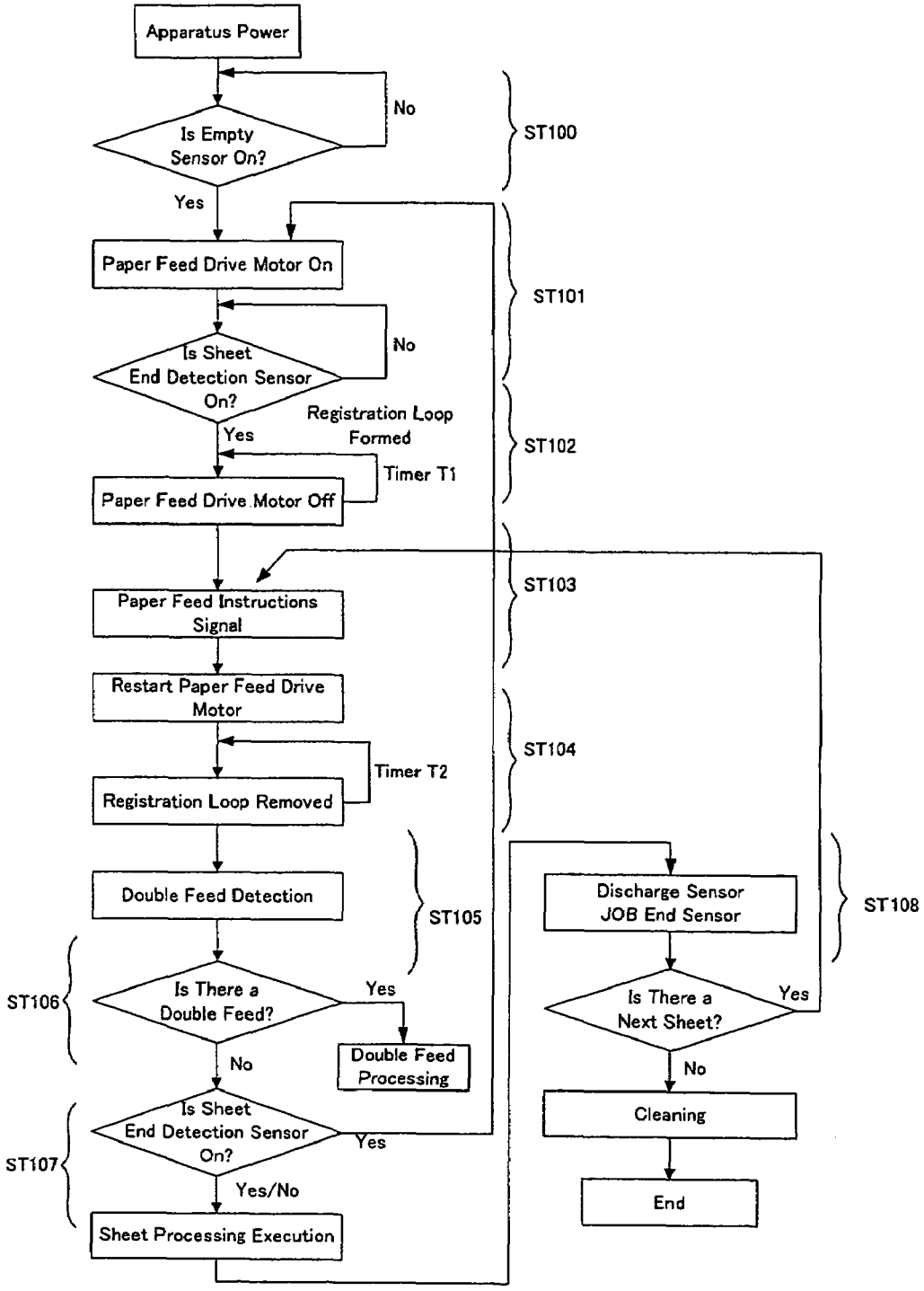
FIG. 10 is a flow chart for explaining a control of the image forming apparatus shown in FIG. 7.
Figure 11A:
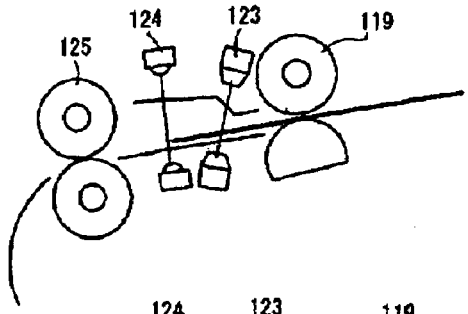
FIGS. 11(*a*) to 11(*e*) are views showing an operation of feeding a sheet in the image forming apparatus shown in FIG. 7.
Figure 11B:
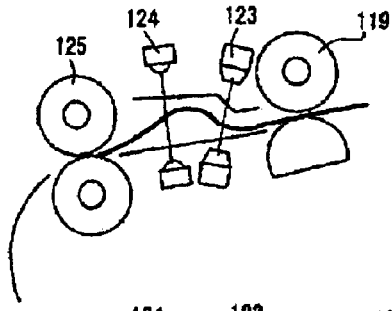
Figure 11C:
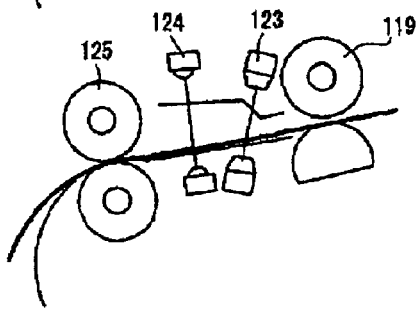
Figure 11D:
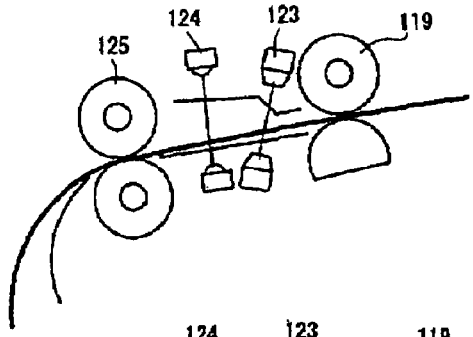
Figure 11E:
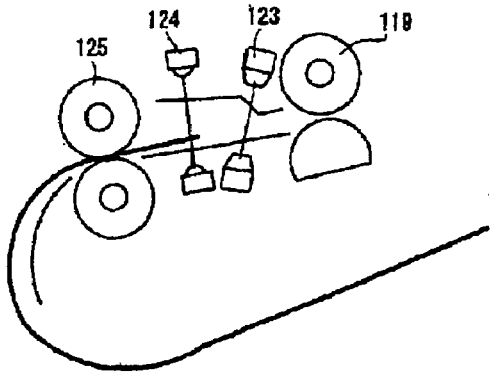

An operation of the apparatus described above will be explained next. FIG. 10 is a flow chart for explaining the operation. When the apparatus is turned on and the sheets are placed on the paper feed stacker 115, the empty sensor 117 detects the sheets and the paper feed drive motor 140 starts (ST100). When the paper feed drive more 140 rotates, the kick roller 118 and separating roller 119 separate the sheets and feed the sheet to the transport guide 128 between the separating roller 119 and the register rollers 125. The sheet edge detection means 124 (hereinafter referred to as sensor 124) detects the leading edge of the sheet (ST101). After the detection signal of the leading edge of the sheet is sent, the timer T1 is activated (see FIG. 5) and the motor 140 stops after a predetermined period of time (ST102).

As shown in FIG. 11(*a*), the sensor 124 detects the leading edge of the sheet and the timer T1 is activated. As shown in FIG. 11(*b*), the leading edge of the sheet abuts against the register rollers 125 to form a loop in the sheet. In this state, a set time of the timer T1 ends and the motor 140 stops. When the paper feed instruction signal is sent from the control unit of the image reading apparatus A, the motor 140 rotates in reverse. Also, with the paper feed instruction signal, the timer T2 is activated. With the timer T2 (see FIG. 5), the register loop is removed and the sheet is supported between the separating roller 119 and the register rollers 125 in a straight line (ST104) as shown in FIG. 11(*c*).

Next, until the trailing edge of the sheet is released from the separating roller 19 as shown in FIG. 11(*d*), the ultrasonic wave sensor 123 detects the double feed of the sheets as described previously (ST105). The sensor 124 detects the trailing edge of the sheet transported in this way (ST106). At the same time, the lead sensor 126 detects the leading edge of the sheet, and the feed roller 127 feeds the sheet toward the platen 112. When the sheet reaches the platen 112, the optical mechanism 114 and the photoelectric converting element 113 perform the reading process to obtain electrical signals. After the reading process, the transport rollers 129 and the discharge rollers 130 discharge the sheet to the discharge stacker 116, and the discharge sensor 145 detects the discharge of the sheet (ST108). Then, the cleaning operation ST09 shown in FIG. 4 is executed.

The disclosure of Japanese Patent Application No. 2003-405439 filed on Dec. 4, 2003 is incorporated in the application.

While the invention has been explained with reference to the specific embodiment of the invention, the explanation is illustrative and the invention is limited only by the appended claims.

What is claimed is:

1. An image reading apparatus comprising:

a processing platen having photoelectric converting means for reading an image on a sheet, a sheet feeding stacker for feeding the sheet to the processing platen, a discharge stacker for storing the sheet discharged from the processing platen, a transport guide for guiding the sheet from the sheet feeding stacker to the processing platen, sheet separating means for sequentially separating and feeding the sheet on the sheet feeding stacker, register means for temporarily holding the sheet transported from the separating means, and an ultrasonic wave sensor arranged between the sheet separating means and the processing platen for detecting the sheet or a double feed of the sheet, said ultrasonic wave sensor having a wave sending element for emitting an ultrasonic wave with a predetermined frequency and a wave receiving element for receiving the ultrasonic waves from the wave sending element, said wave sending element being arranged at a lower position in a direction of gravity relative to the sheet transport guide, said wave receiving element being arranged at an upper position opposite to the lower position, said wave sending element having a wave sending surface inclined with a first predetermined angle relative to a horizontal direction, a piezoelectric diaphragm, and an oscillation circuit for exciting the piezoelectric diaphragm with a specific frequency, said oscillation circuit selectively exciting the piezoelectric diaphragm with at least two different amplitudes, wherein said wave sending element further includes a casing with said wave sending surface directly facing the wave receiving element, said piezoelectric diaphragm being fixed to the casing at a side opposite to the wave sending surface to oscillate the casing, and said oscillation circuit supplies power to the piezoelectric diaphragm greater than that required to detect the sheet when a sheet detection is not performed so that dust on the wave sending surface is removed.

2. An image reading apparatus according to claim 1, wherein said wave sending element and said wave receiving element face each other and are disposed between the sheet separating means and the register means, said oscillation circuit exciting the piezoelectric diaphragm with a predetermined ultrasonic wave before the sheet reaches the wave sending element or after the sheet passes the wave sending element.

3. An image reading apparatus according to claim 1, wherein said oscillation circuit excites the piezoelectric diaphragm with a predetermined ultrasonic wave when the image reading apparatus is initialized.

4. An image reading apparatus according to claim 1, wherein said oscillation circuit excites the piezoelectric diaphragm with a predetermined ultrasonic wave upon a job end signal when the sheet is read at the processing platen.

5. An image reading apparatus according to claim 1, wherein said oscillation circuit supplies a predetermined frequency voltage to the piezoelectric diaphragm continuously so that the piezoelectric diaphragm generates a continuous wave, or supplies the predetermined frequency voltage to the piezoelectric diaphragm intermittently so that the piezoelectric diaphragm generates a burst wave.

* * * * *